US005288283A

United States Patent [19]

Meeker

[11] Patent Number: 5,288,283

[45] Date of Patent: Feb. 22, 1994

[54] DOORWAY EXERCISER

[75] Inventor: Paul K. Meeker, Aurora, Ohio

[73] Assignee: Lisco, Inc., Tampa, Fla.

[21] Appl. No.: 8,024

[22] Filed: Jan. 25, 1993

[51] Int. Cl.[5] ..... A63B 22/00

[52] U.S. Cl. ..... 482/69; 482/904; 297/274

[58] Field of Search ..... 482/143, 904, 69; 297/274, 275; 269/97, 156, 254 R, 258, 268; D6/333; D8/72, 73

[56] References Cited

U.S. PATENT DOCUMENTS

| | | | |
|---|---|---|---|
| D. 305,722 | 1/1990 | Riehm | D8/72 |
| 73,801 | 1/1868 | Hale . | |
| 178,680 | 6/1876 | Shaw . | |
| 382,814 | 5/1888 | Jones | 297/275 |
| 384,512 | 6/1888 | Dillon . | |
| 641,316 | 1/1900 | Meyer . | |
| 794,484 | 7/1905 | Bowie . | |
| 955,954 | 4/1910 | Emerick . | |
| 1,005,975 | 3/1913 | Hawk . | |
| 1,126,291 | 1/1915 | Rundle . | |
| 1,215,652 | 2/1917 | Hale . | |
| 1,339,296 | 5/1920 | Sparks . | |
| 1,346,973 | 7/1920 | Padden . | |
| 1,354,907 | 10/1920 | Hopaidaszka . | |
| 1,757,423 | 5/1930 | Gerrond . | |
| 2,317,243 | 4/1943 | Anderegg . | |
| 2,655,198 | 10/1953 | Williams et al. | 297/274 |
| 3,314,636 | 4/1967 | McHugh . | |
| 4,639,837 | 1/1987 | Yokota | 385/115 X |
| 4,697,577 | 10/1987 | Forkner | 128/6 |
| 4,747,661 | 5/1988 | Ohkuwa | 128/6 X |
| 4,779,613 | 10/1988 | Hashiguchi et al. | 128/6 |
| 4,809,678 | 3/1989 | Klein | 128/4 |
| 4,942,867 | 7/1990 | Takahashi et al. . | |
| 4,991,564 | 2/1991 | Takahashi et al. . | |
| 4,991,565 | 2/1991 | Takahashi et al. . | |
| 4,998,182 | 3/1991 | Krauter et al. | 128/6 X |
| 5,050,585 | 9/1991 | Takahashi . | |
| 5,105,800 | 4/1992 | Takahashi et al. . | |

*Primary Examiner*—Richard J. Apley
*Assistant Examiner*—Lynne A. Reichard
*Attorney, Agent, or Firm*—Donald R. Bahr; John E. Benoit

[57] ABSTRACT

A doorway exerciser comprising a scissor-type spring-biased clamp for securing the exerciser above the upper doorframe and a strap adjustable in length removably secured to the clamp and extending downwardly. The strap passes downwardly into a tube having a compression spring therein, through a slotted plate at the bottom of the spring, and returns upwardly and is secured to itself. The tube is preferably of plastic and has opposed ears extending therefrom with a slotted orifice in each ear. A loop at one end of each of two flexible straps passes through each orifice. The other ends of the straps are removably secured to the ends of slats which support a fabric seat.

4 Claims, 3 Drawing Sheets

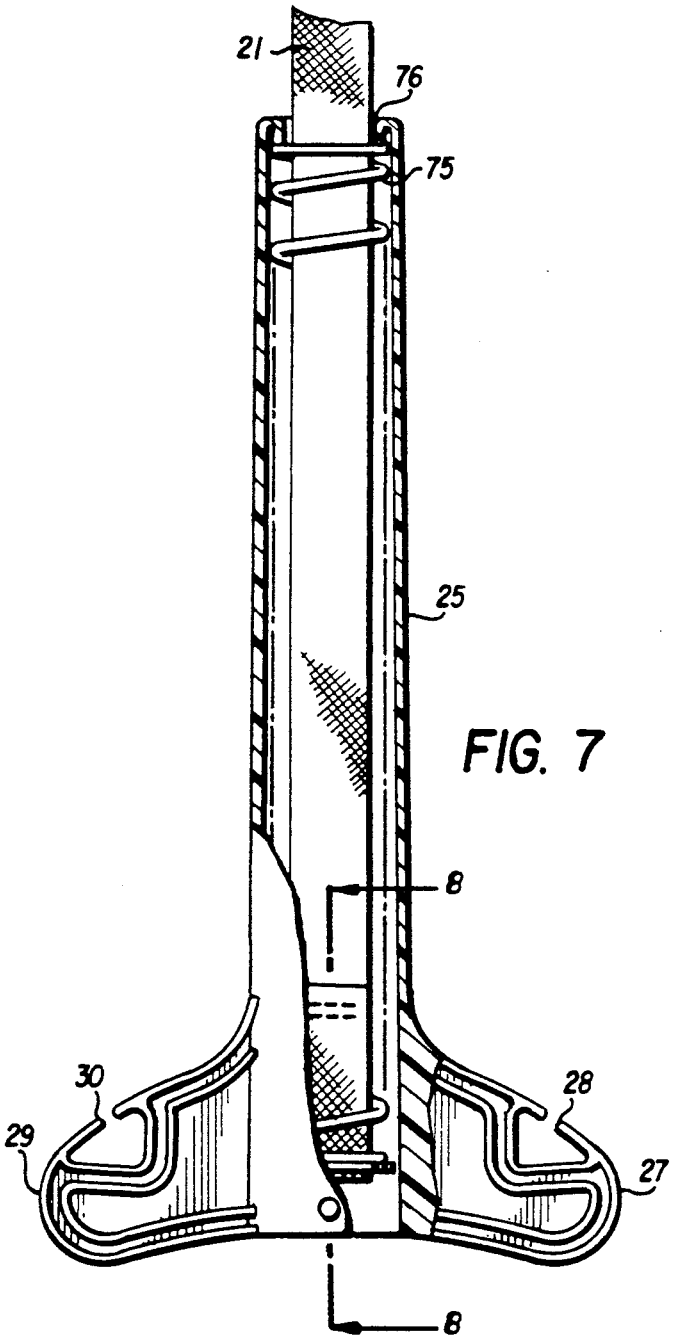
FIG. 7
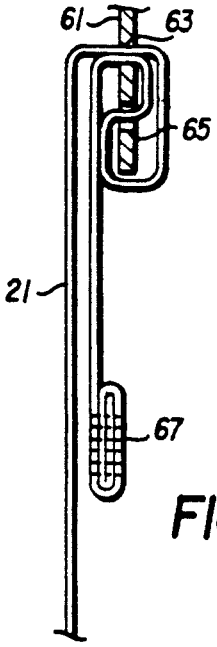
FIG. 6
FIG. 5
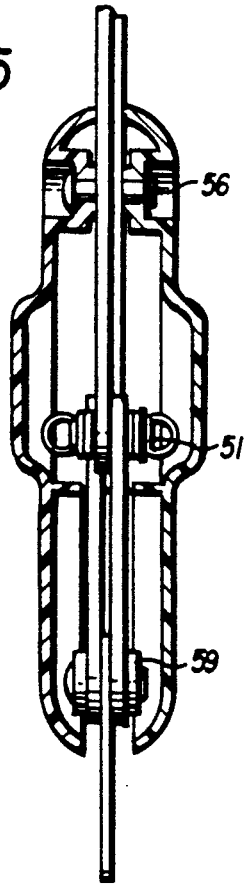
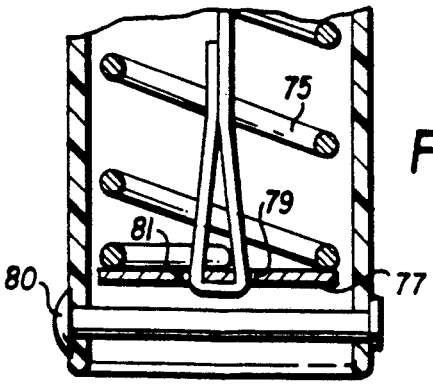
FIG. 8

DOORWAY EXERCISER

This invention relates generally to doorway exercisers and more specifically to doorway exercisers which use a compression spring and which may be assembled and disassembled by the user.

Current doorway exercisers, which are also known as "jumpers," use a system wherein extension springs perform the necessary resiliency for the jumping action. These springs are extension springs with looped ends. Since extension springs are subject to failure, with the resultant failure of jumping springs allowing a baby using the jumper to fall, jumpers typically have safety cords inside the spring. Further, exposed springs, typical of current jumpers, need more expensive finishes in order to approve their general appearance. The additional of end loops, safety cords, and necessary plating adds considerable expense to such a jumper.

Accordingly, it is an object of the present invention to provide a doorway exerciser which uses a simple compression spring housed inside of a rigid tube, preferably plastic. Such a spring has no need for any particular configuration and further has no need for a safety cord as it is inherently fail-safe. Additionally, no special plating or the like is needed to enhance the appearance of the device.

A further object of the invention is to provide a doorway exerciser which may be easily assembled and disassembled by the user so that it may be stored or any parts may be easily cleaned or replaced.

SUMMARY OF THE INVENTION

The present invention relates to a doorway exerciser comprising a scissor-type spring-biased clamp for securing the exerciser above the upper doorframe. A strap is secured to the scissor-type clamp and extends downwardly therefrom. The strap then passes into a tube which contains a compression spring therein. The strap passes through a slotted plate adjacent the bottom of the spring and returns upwardly within the spring and is then secured to itself. The tube is of a rigid material and has integral opposed ears extending therefrom with a slotted orifice in each ear. A flexible strap passes through and is removably secured within each orifice. Each strap terminates at the other end in a further loop with these loops removably secured to slats which pass through and support a fabric seat.

BRIEF DESCRIPTION OF THE DRAWINGS

FIG. 5 is partial sectional view taken through lines 5—5 of FIG. 3;

FIG. 6 is a partial sectional view taken through lines 6—6 of FIG. 2;

FIG. 7 is a partial sectional view of the tube and spring of FIG. 1;

FIG. 8 is a sectional view taken through the lines 8—8 of FIG. 7.

DETAILED DESCRIPTION OF THE PREFERRED EMBODIMENT

Figure 1:
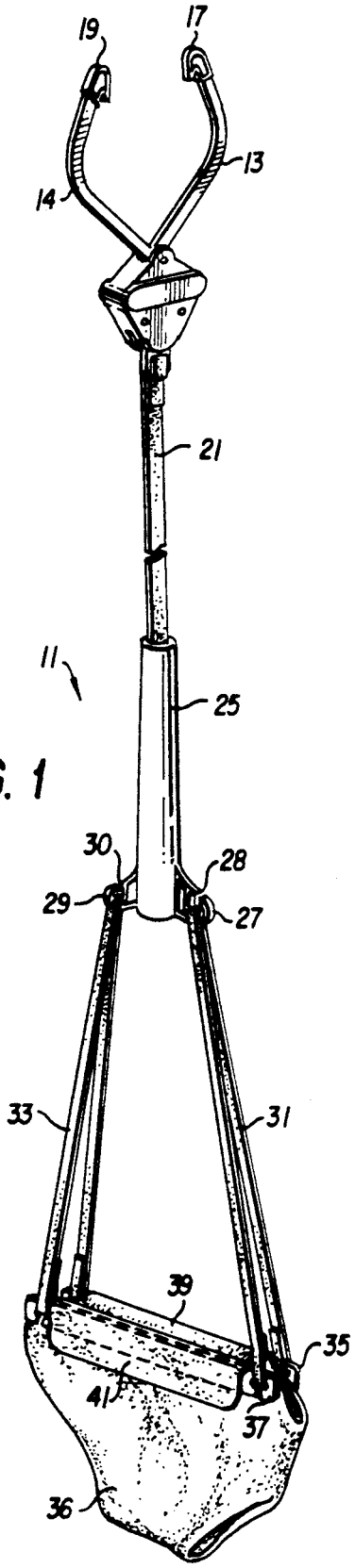
FIG. 1 is a perspective view of one embodiment of the present invention.

Referring to FIG. 1, there is shown doorway exerciser 11 of the present invention. Exerciser 11 includes a scissor-type clamp having arms 13 and 14 with an extension spring 15 (FIG. 3) urging the arms in the direction wherein they meet. The upper ends of arms 13 and 14 terminate in jumper hooks 17 and 19, respectively.

Figure 2:
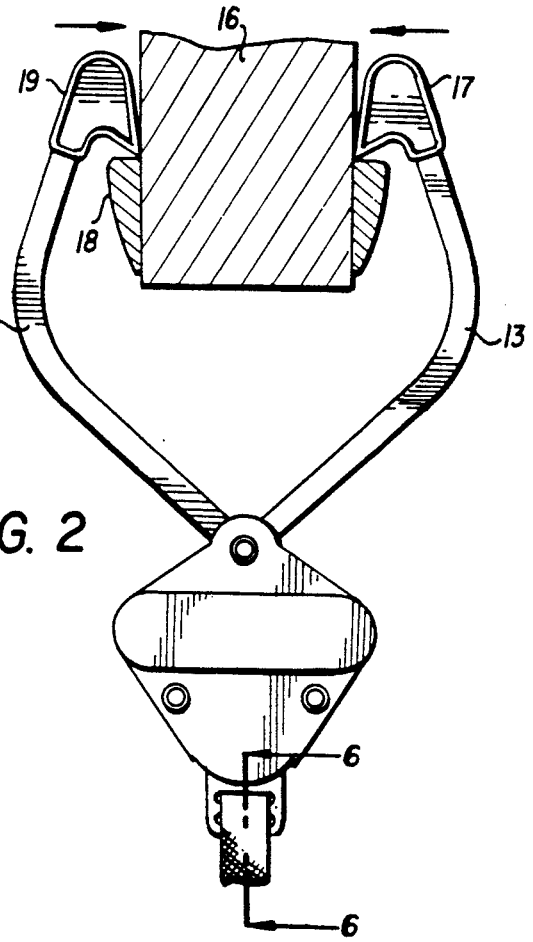
FIG. 2 is an enlarged plan view of the clamp of FIG. 1 shown mounted on a doorjamb.

The lower part of the scissor-type clamp will be described in detail as the description proceeds. In FIGS. 1 and 2 this part of the clamp is enclosed by housing 20. Housing 20 is open at its upper and lower ends so as to accommodate the structure described below.

Strap 21 passes through slotted plate 50 and is secured to itself at one end, as more clearly shown in FIG. 6. Strap 21 extends downwardly and into tube 25. Again, the details of tube 25 will be discussed as the description proceeds. Tube 25 is preferably molded of a sturdy plastic or the like and has integral therewith ears 27 and 29. Straps 31 and 33 are removably secured within slots 28 and 30 of ears 27 and 29 and the ends of the straps extend downwardly to be removably secured to slats 35 and 37, which pass through loops 39 and 41 in flexible seat 36.

Referring to FIG. 2, jumper hooks 17 and 19 are shown resting on molding 18 so as to secure the exerciser above the doorway.

Figure 4:
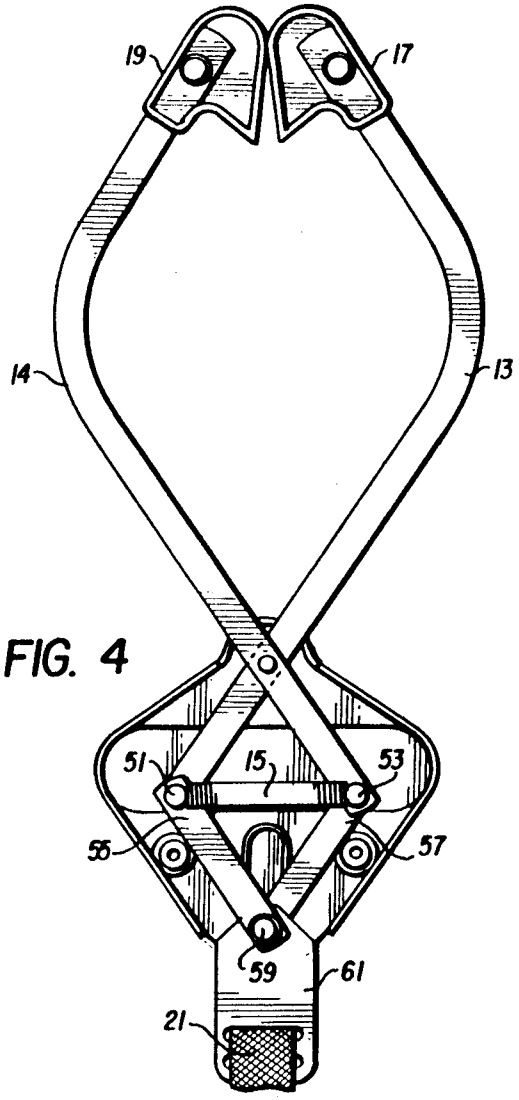
FIG. 4 is a view as in FIG. 3 with the arms closed.
Figure 3:
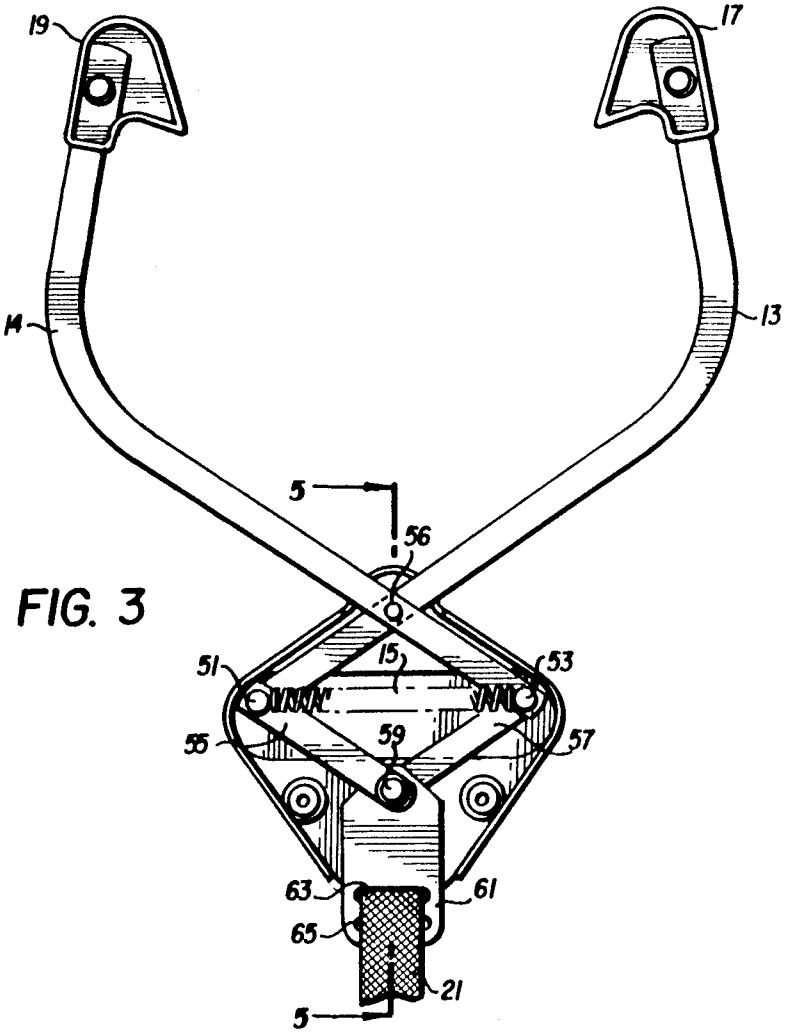
FIG. 3 illustrates the clamp of FIG. 2 with the cover removed and the arms extended.

Referring to FIGS. 3, 4, and 5, which show the clamping mechanism with the front cover removed, arm 13 terminates at its lower end at pivot pin 51 while arm 14 terminates at its lower end at pivot pin 53. Arms 13 and 14 are connected by pivot pin 56. Links 55 and 57 complete the scissor action and are commonly connected at pivot pin 59. Extension spring 15 is connected between pivot pins 51 and 53 so as to bias jumper hooks 17 and 19 toward a closed position. Plate 61 is connected at pivot pin 59 and retaining strap 21. It will be obvious that, in addition to the bias pressure exerted by spring 15, any downward pressure on strap 21 will cause further pressure on the scissor-type clamp so as to force arms 13 and 14 securely against wall 16 while resting on frame 18, as shown in FIG. 2.

FIG. 6 discloses the details of the means for adjusting the length of strap 21 so as to obtain the proper height of seat 36. Plate 61 includes orifices 63 and 65. The end of strap 21 passes through orifice 63, downward and through orifice 65, upward and back through orifice 63. The distal end is folded upon itself and secured by stitching 67. This prevents the distal end of the strap from passing through orifices 63 and 65. With this arrangement, the length of strap 21 above tube 25 can be adjusted.

FIGS. 7 and 8 disclose the details of the spring mechanism included within tube 25. Compression spring 75 is contained within tube 25 and is retained at the upper end by the tube itself since orifice 76 is of a smaller diameter than the diameter of the spring. The spring is particularly designed so that the last upper and lower coils are in a plane substantially at 90° to the linear axis of the spring. This avoids any problems with contact with the spring only at a particularly point rather than flush against the coil.

Slotted plate 77 abuts against the lower end of the spring and, as can be seen from FIG. 8, strap 21 passes down through slot 79, across the plate and upward through slot 81, and along the axis of the spring and is secured to itself by stitching or the like. Plate 77 has a diameter greater than the diameter of the spring.

FIG. 7 also shows in more detail ears 27 and 29, which are an integral part of plastic tube 25, As can be seen, the ears include slotted orifices 28 and 30, which permit the center part of straps 31 and 33 to be slipped through the slots and held within the orifices, as shown in FIG. 1. In order to obtain stability, the loops may be stitched together just below ears 27 and 29, as shown.

Further, in order to prevent spring 75 and plate 77 from moving outwardly of the bottom of the tube when the seat is disassembled, rivet 79 or the like may be passed through the bottom of tube 25 after the spring, plate, and strap are in place.

A primary advantage of using the removable strap is that it permits the consumer to easily assemble the product, thereby allowing the manufacturer to eliminate labor costs so as to provide a lower-priced product. Also, it would reduce the packaging problems as far as the disassembled product is concerned. Further, it permits the consumer to replace defective or worn parts without any major problems or the need for any specific tools.

Figure 9:
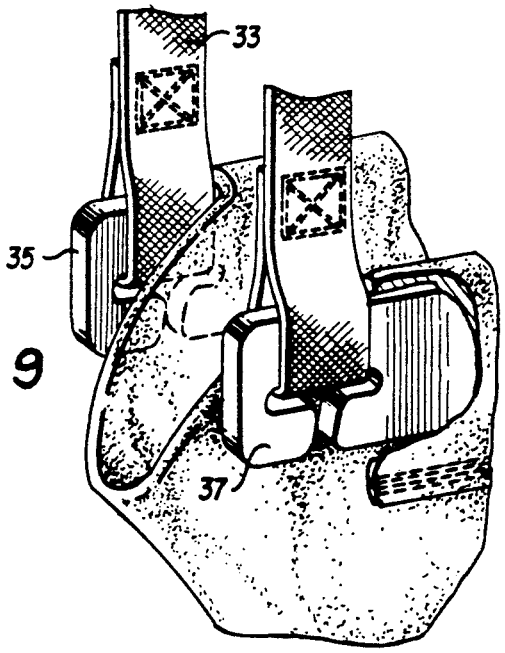
FIG. 9 is an enlarged perspective view of the ends of one of the seat supporting straps and associated slat shown in FIG. 1.

Referring to FIG. 9, opposite ends of strap 33 terminate in loops which fit into C-slots at both ends of slats 35 and 37. Opposite ends of strap 31 (FIG. 1) are secured in the same manner.

The advantage of the plastic slats passing through sewn loops in the fabric seat is that the seat can be sewn as a very simple part and the consumer can accomplish the final assembly with little problem. Additionally, it is quite obvious that the consumer can easily remove the fabric seat for laundering in a washing machine.

Finally, the advantage of the entire configuration discussed above is that the spring is inherently fail-safe, the product is less expensive to manufacture, and it is easy for the consumer to assemble and disassemble the entire exerciser for cleaning or replacing of parts.

The above description and drawings are illustrative only since equivalent components can be used without departing from the invention, the scope of which is to be limited only by the following claims.

I claim:

1. A doorway exerciser comprising clamping means adapted to fit above a doorway framework;

strap means secured to said clamping means at one end thereof;

a substantially rigid tube having a reduced opening at one end thereof;

a compression spring within said tube, said spring having an outer diameter greater than the diameter of said reduced opening at said one end of said tube;

a slotted plate abutting the end of said spring opposite said reduced opening;

the other end of said strap means passing into said reduced opening of said tubing, through said spring and said slots in said slotted plate and secured to itself;

a seal;

opposed ears integral with and extending outwardly from said tube;

slotted orifices in each of said ears; and flexible straps secured to said seat and terminating at their distal ends in loops which are removably retained in said slotted orifices, whereby downward pressure on said seat causes compression of said spring and pressure on said clamping means.

2. The doorway exerciser of claim 1 further comprising means for adjusting the length of said strap means.

3. The exerciser of claim 1 wherein the means for securing said strap means to said clamping means comprises a plate secured to said clamping means; and parallel slots in said plate whereby said one end of said strap is adjustably positioned through said slots.

4. The doorway exerciser of claim 1 wherein said clamping means comprises a scissor-type clamp having opposed arms;

jumper hooks at the distal ends of said arms adapted for mounting on the top of a door molding; and an extension spring mounted in said clamp for biasing said jumper hooks toward each other.

* * * * *